United States Patent [19]

Jimbo et al.

[11] Patent Number: 5,005,697

[45] Date of Patent: Apr. 9, 1991

[54] MAKE-UP CASE

[75] Inventors: Keiji Jimbo, Naka; Yuuji Yasui, Hachioji; Sigeru Taninaga, Minamiashigara, all of Japan

[73] Assignee: Kanebo Limited, Tokyo, Japan

[21] Appl. No.: 568,196

[22] Filed: Aug. 15, 1990

Related U.S. Application Data

[63] Continuation-in-part of Ser. No. 793,463, Oct. 29, 1985, abandoned, which is a continuation of Ser. No. 636,788, Aug. 1, 1984, abandoned, which is a continuation of Ser. No. 436,424, Oct. 25, 1982, abandoned.

[30] Foreign Application Priority Data

Oct. 27, 1981 [JP] Japan ..... 56-160913

[51] Int. Cl.[5] ..... B65D 21/00

[52] U.S. Cl. ..... 206/235; 132/294; 132/315; 132/316; 206/581; 206/818; 206/823

[58] Field of Search ..... 206/37, 229, 581, 818, 206/823, 1.8, 1.9, 235; 132/286, 287, 293, 294–297, 300, 303, 314, 315, 316; 220/DIG. 26

[56] References Cited

U.S. PATENT DOCUMENTS

| | | | |
|---|---|---|---|
| 1,872,864 | 8/1932 | Yarcho | 206/1.8 |
| 2,454,527 | 11/1948 | Taschereau | 220/DIG. 26 |
| 2,988,410 | 6/1961 | Weisz | 206/818 |
| 3,971,361 | 7/1976 | Hurko | 206/818 |

FOREIGN PATENT DOCUMENTS

| | | | |
|---|---|---|---|
| 2747836 | 5/1979 | Fed. Rep. of Germany | 206/818 |
| 1421505 | 11/1965 | France | 248/206.5 |

*Primary Examiner*—Jimmy G. Foster
*Attorney, Agent, or Firm*—Paul & Paul

[57] ABSTRACT

A make-up case comprising in the inside thereof a plurality of cosmetics pans, wherein the bottom of each pan is provided with a magnet and the inner bottom of the case is provided with a magnetic material, or vice versa, the magnetic material being attracted to the magnet, whereby the plurality of cosmetics pans are removably arranged in the inside of the case.

1 Claim, 1 Drawing Sheet

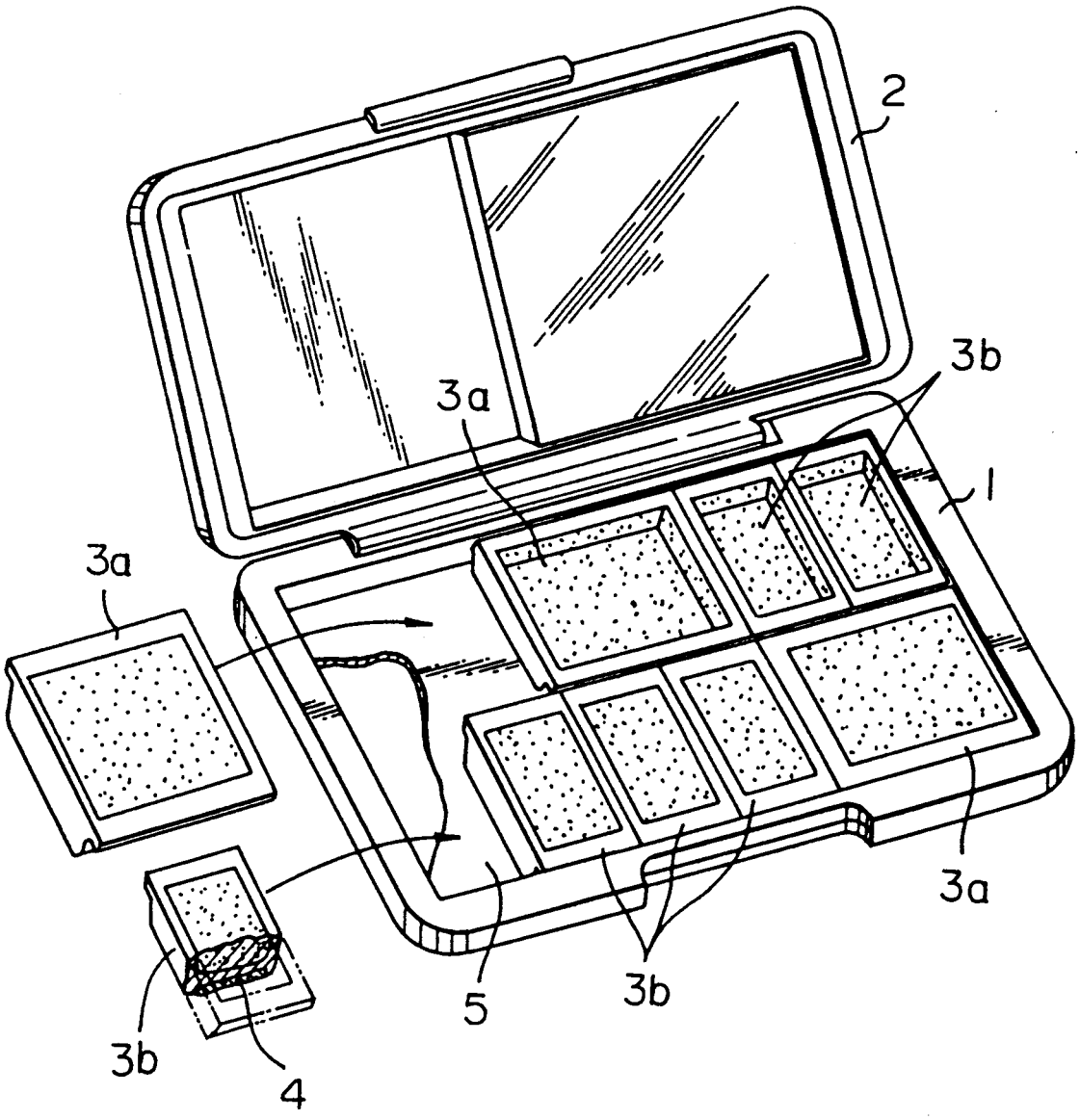
2
3b
3a
1
3a
3a
5
3b
3b
4

MAKE-UP CASE

This application in part discloses and claims subject matter disclosed in my earlier filed pending applications, Serial No. 793,463, filed Oct. 29, 1985, now abandoned, which is a continuation application of application Serial No. 636,788, filed Aug. 1, 1984 (now abandoned), which is a continuation application of application Serial No. 436,424, filed Oct. 25, 1982 (now abandoned).

BACKGROUND OF THE INVENTION

1. Field of the Invention

The invention relates to an improvement in a palette-type make-up case or compact for containing, as a set, several kinds of make-up, such as powder, eye shadow, rouge, etc.

2. Description of the Prior Art

In a conventional palette-type make-up case, cosmetics pans are firmly fixed to the inside of the case with an adhesive or the like. Thus, when one pan becomes empty, the make-up case must be discarded. In addition, the make-up case can containing only the make-up in the cosmetics pans originally fixed to the inside of the case; i.e., no other make-up can be substituted for the original make-up, even if it is so desired.

In Japanese Unexamined Utility Model Publication (Kokai) No. 56-69307, there is proposed a mechanism for mounting removable cosmetics pans in a make-up case by the engagement of an undercut portion and a raised portion. However, this mechanism involves a relatively complicated construction which makes the removal of the pans difficult and, further, renders the flexibility in arrangement of the pans poor.

SUMMARY OF THE INVENTION

The primary object of the present invention is to provide a convenient, improved make-up case in which cosmetics pans can be easily removed but securely mounted in a desired order and in which the cosmetics pans can easily be rearranged or replaced with new cosmetics pans if desired.

Thus, the present invention provides a make-up case comprising in the inside thereof a plurality of cosmetics pans, wherein the bottom of each pan is provided with a magnet and the inner bottom of the case is provided with a magnetic material, or vice versa, the magnetic material being attracted to the magnet, whereby the plurality of cosmetics pans can be removably arranged in the inside of the case.

BRIEF DESCRIPTION OF THE DRAWING

The FIGURE is a perspective, partially sectional view of an open make-up case, an embodiment of the make-up case according to the present invention, in which two cosmetics pans have been demounted.

DESCRIPTION OF THE PREFERRED EMBODIMENTS

Referring to the figure, the flat, rectangular, palette-type outer case is formed of a top member 2 and a bottom member 1, the top member 2 being hinged to the bottom member 1, which is in the form of a rectangular dish, so that the top member 2 can be easily opened and closed. In the bottom member 1, rectangular cosmetics pans 3*a* and 3*b* of two different sizes are parallelly arranged in two columns, and various kinds of make-up is filled into the pans 3*a* and 3*b*.

Each of the cosmetic pans has at least one width-wise projected top edge of a prescribed width so as to be adapted to effect said manually applied force.

According to the present invention, the bottom of each of the pans 3*a* and 3*b* is provided with a magnet, such as a rubbernet, and the inner bottom of the bottom member 1 is provided with a magnetic material, or vice versa, the magnetic material being a metal plate, e.g., an iron plate, or a magnet, which is attracted to the magnet so that the respective cosmetics pans 3*a* and 3*b* can be fittingly arranged on the inner bottom of the bottom member 1. Thus, the cosmetics pans do not become dislodged by gravitational forces but are removal by a manually applied force greater than the force of magnetic attraction. In the case of the embodiment shown in the figure, a magnet 4 in the form of a plate is provided on the bottom of each of the cosmetics pans 3*a* and 3*b* while an iron plate 5 is provided on the inner bottom of the bottom member 1 so that the respective pans 3*a* and 3*b* can easily be mounted on the inner bottom of the bottom member 1 as desired. A rubbernet is preferably used as the magnet 4 since it makes a soft contact with the magnetic material. The size and number of magnets and/or magnetic materials may properly be selected, and the location of the magnets and/or magnetic materials is not critical. The magnets and/or magnetic materials may be attached to the cosmetics pans or to the inner bottom of the bottom member 1 with an adhesive or by insert molding during the molding of the resin portions of the pans or the bottom member 1.

It is desirable that the larger cosmetics pans 3*a* have a width two fold or more that of the smaller cosmetics pans 3*b* so that one larger pan can be substituted for two or more smaller pans or vice versa. Accordingly, it is possible for cosmetics pans of three or more different widths to be provided in the make-up case. Further, it is advantageous for the inner width of the bottom member 1 to be of several times that of the smaller cosmetics pans 3*b*.

The bottom member 1 may further be provided, if so desired, with one or more compartments for containing a brush, a powder puff, an eyebrow pencil, and the like. Furthermore, the top member 2 may be provided with a mirror or the like.

In the make-up case of the present invention, as explained above in detail, the bottom of each of the cosmetics pans 3*a* and 3*b* to be contained in the bottom member 1 is provided with the magnet 4 and the inner bottom of the bottom member 1 is provided with the magnetic material 5, or vice versa, so that the cosmetics pans are removably mounted on the inner bottom of the bottom member 1 with the aid of a magnetic force. Therefore, if one of the cosmetics pans 3*a* and 3*b* containing powder, eye shadow, or the like therein becomes empty, the empty pan can easily be removed in spite of the magnetic force and a new pan 3*a* or 3*b* filled with make-up can be substituted for the empty pan, the new pan being fittingly mounted with the aid of the magnetic force. In this way, the make-up case can continue to be used since all of the cosmetics pans therein can continuously contain make-up. Further, additional cosmetics pans containing different kinds of and different colors of make-up can be prepared and can be substituted for the cosmetics pans 3*a* and 3*b* according to the user's desire or so as to correspond to the season, thereby making the optional selection of and the combination of different kinds of make-up wider. Furthermore, it is possible to optionally rearrange the cosmetics pans 3*a* and 3*b* within the bottom member 1 of the make-up case.

As explained above in detail, in the make-up case according to the present invention, since the cosmetics pans are mounted with the aid of a magnetic force, the cosmetics pans can easily be removed and easily mounted so that substitution of the cosmetics pans can easily be carried out. In particular, in a palette-type make-up case in which several kinds of make-up are contained in a set, the make-up case can be used for a long period of time since new cosmetics pans filled with make-up can be substituted for the empty cosmetics pans, with the result that all of the cosmetics pans therein can continuously contain make-up. Therefore, the make-up case of the present invention is economically advantageous and, further, is very practical since the cosmetics pans can be optionally arranged and selected so that different colors of and different kinds of make-up can be substituted as desired.

We claim:

1. A make-up tray containing at least two rows of cosmetics pans of rectangular shape, said pans having uniform dimensions in one direction, said pans in the other direction having at least two different dimensions the larger of which is in an integer multiple of the smaller, and means providing magnetic attraction between the bottoms of said pans and the inner bottom of the said make-up case, wherein said pans do not become dislodged by gravitational forces but are removal by a manually applied force grater than the force of magnetic attraction and where each of the cosmetics pans has at least one width-wise projected top edge adapted to effect said manually applied force.

* * * * *